US007658146B2

(12) United States Patent
Reinholdt

(10) Patent No.: US 7,658,146 B2
(45) Date of Patent: Feb. 9, 2010

(54) INKING-PAD PRINTING SYSTEM

(75) Inventor: Holger Reinholdt, Freudenstadt (DE)

(73) Assignee: ITW Morlock GmbH, Dornstetten, DE (US)

( * ) Notice: Subject to any disclaimer, the term of this patent is extended or adjusted under 35 U.S.C. 154(b) by 234 days.

(21) Appl. No.: 11/670,686

(22) Filed: Feb. 2, 2007

(65) Prior Publication Data

US 2007/0181013 A1 Aug. 9, 2007

(30) Foreign Application Priority Data

Feb. 3, 2006 (DE) ..... 10 2006 005 073

(51) Int. Cl.
*B41F 17/24* (2006.01)

(52) U.S. Cl. ..... 101/163; 101/407.1; 269/312

(58) Field of Classification Search ..... 101/41, 101/43, 44, 163, 42, 170, 407, 474, 490, 101/492, 493; 269/43, 312; *B41F 17/00; B05C 13/02*
See application file for complete search history.

(56) References Cited

U.S. PATENT DOCUMENTS

| | | | | |
|---|---|---|---|---|
| 874,790 | A * | 12/1907 | Patterson | 101/301 |
| 2,334,127 | A * | 11/1943 | Ringzelli | 269/312 |
| 3,916,784 | A | 11/1975 | Dubuit | |
| 5,383,398 | A * | 1/1995 | Binnen | 101/41 |
| 5,662,041 | A | 9/1997 | Kleist | |
| 6,158,341 | A | 12/2000 | Holmberg | |
| 6,393,181 | B1 | 5/2002 | Bulman et al. | |
| 2002/0125588 | A1 * | 9/2002 | Ikeda et al. | 264/1.6 |

FOREIGN PATENT DOCUMENTS

| | | | |
|---|---|---|---|
| CH | 635482 | A5 | 4/1983 |
| DE | 3412497 | A1 | 10/1985 |
| DE | 3717179 | A1 | 12/1988 |
| DE | 4431596 | C1 | 10/1995 |
| DE | 10129094 | A1 | 2/2003 |
| EP | 0379447 | A1 | 7/1990 |
| GB | 2305633 | | 4/1997 |
| WO | 99/15334 | A1 | 4/1999 |
| WO | 01/70504 | A1 | 9/2001 |

OTHER PUBLICATIONS

ISR and Written Opinion for PCT/IB2007/000237 dated Jun. 27, 2007.

* cited by examiner

*Primary Examiner*—Judy Nguyen
*Assistant Examiner*—Jennifer Simmons
(74) *Attorney, Agent, or Firm*—Lowe Hauptman Ham & Berner, LLP

(57) ABSTRACT

A pad printing system includes a pad printing machine and an object positioning device. The object positioning device is a multiple positioning device by means of which an object support may be consecutively positioned at a print station each time.

10 Claims, 2 Drawing Sheets

INKING-PAD PRINTING SYSTEM

RELATED APPLICATIONS

The present application is based on, and claims priority from, German Application Number 10 2006 005 073.8, filed Feb. 3, 2006, the disclosure of which is hereby incorporated by reference herein in its entirety.

TECHNICAL FIELD

The present invention relates to a pad printing system.

BACKGROUND OF THE INVENTION

Pad printing machines are known for instance from the U.S. Pat. Nos. 5,662,041; 6,393,181 B1 and French patent document 0 379 447 A1.

SUMMARY OF THE INVENTION

There is a need of creating a more compact system that allows running different printing programs and switching in simple and rapid manner from one printing program to another.

A pad printing system includes a pad printing machine fitted with at least one pad printing unit to apply a print to an object in at least one print station. An object positioning device is located at least one of the print stations, the object positioning device being fitted with an object support to hold an object to be printed in a position where it may be printed in said print station. The object positioning device is a multi-positioning device by means of which the object support jointly with an object to be printed shall be positionable automatically and sequentially in each of at least two different print positions in the same print station in order to print the object at a minimum of two corresponding print positions. The pad printing machine is adapted to print the particular object at the same print station sequentially at the different print positions at its particular areas to be printed. A numerical program control unit for the operations of the pad printing machine and of the object positioning device, said operations of the pad printing machine and of the object positioning device being matched to each other by the program control of the control unit.

BRIEF DESCRIPTION OF THE DRAWINGS

The present invention is elucidated below by illustrative embodiments shown in the appended drawings.

DETAILED DESCRIPTION OF THE EMBODIMENTS

Figure 1:
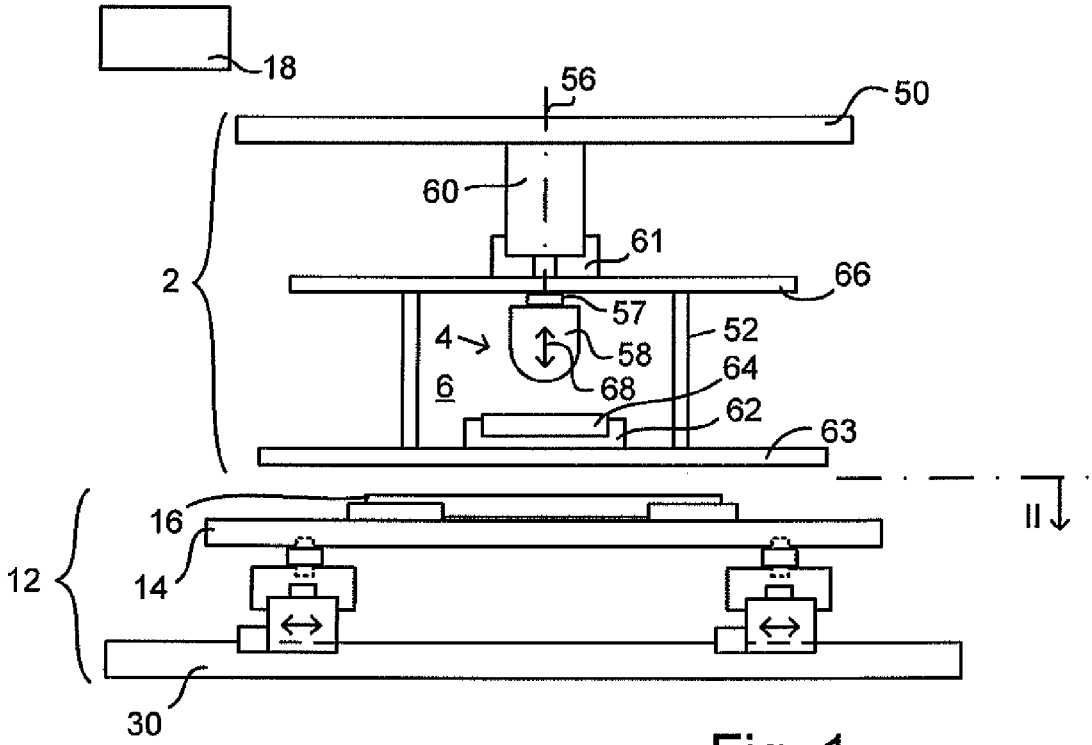
FIG. 1 illustratively shows a schematic sideview of a pad printing system of the invention displaying only a few details for comprehensibility.
Figure 2:
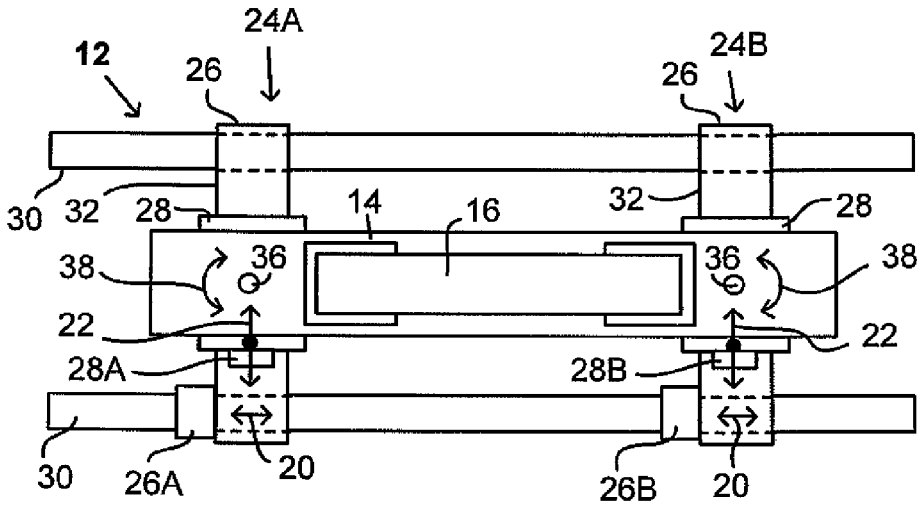
FIG. 2 is a topview of an object-positioning device of FIG. 1 as seen in the direction of the arrow II of FIG. 1, one object carrier being configured parallel to a longitudinal guide.
Figure 3:
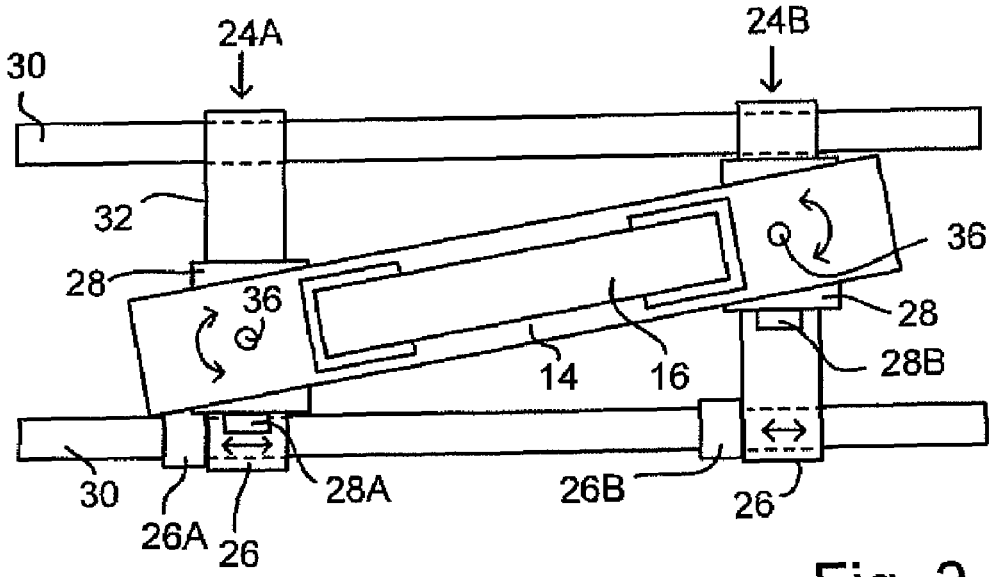
FIG. 3 is a schematic topview of the object positioning device similar to that of FIG. 2, however the object support having been rotated into an oblique position relative to the longitudinal guide.

The pad printing system schematically shown in the drawings comprises a pad printing machine 2 fitted for instance with four printing pad units (or at least one printing pad unit or more, for instance six printing pad units) to print an object 16 at a print station 6.

Said pad printing system moreover includes an object positioning device 12 at the print station 6. The object positioning device 12 comprises an object support 14 to hold an object to be printed 16 in a print position in the print station 6. The object positioning device 12 is a multiposition implement by means of which the object support 14 together with an object to be printed 16 may be automatically and sequentially positioned each time at least one of two different print positions within the same print station 6 in order to sequentially print the object 16 on at least two of its different localized print areas. The pad printing machine 2 is designed in a manner that the particular object 16 shall be printed in the same print station 6 in sequence at the different print positions at the different localized print areas.

A numerical control unit 18 is used for the numerical program control of the operations of the pad printing machine 2 and of the object positioning device 12 and to coordinate said operations. By exchanging or altering the programs of the control unit 18, the pad printing system can be simply and rapidly converted to print small lots of diverse objects 16.

The object positioning device 12 is designed to move the object support 14 in two mutually orthogonal coordinates 20 and 22. Preferably the coordinate axes 20 and 22 are in one common plane.

In a preferred embodiment mode of the invention, the object positioning device 12 is fitted with at least one compound slide unit 24*a* (or 24*b*) and comprises a longitudinal slide 26 and a transverse slide 28. The longitudinal slide 26 is displaceable along a longitudinal coordinate axis 20 and guided in a longitudinal guide 30, for instance two guide rails. The transverse slide 28 is displaceable along a transverse coordinate axis 22 and is guided by a transverse guide 32 at the longitudinal slide 26. The longitudinal guides 30 and/or the transverse guides 32 may be rails, ribs, grooves or edges. For instance the longitudinal guides 30 may be the side edges of a machine frame; and the cross-guides 32 may be side edges of the longitudinal slide 26. The transverse coordinate axis 22 runs transversely to the longitudinal coordinate axis 20, for instance at 90° to it. The object support 14 is mounted on the cross-slide 28. The longitudinal slide 26 and the transverse slide 38 allow positioning the object support 14 and the object 16 borne on it along the longitudinal coordinate axis 20 and along the transverse coordinate axis 22. When the displacements along both axes 20 and 22 are superposed, motions also oblique to both said axes will be feasible.

In one preferred embodiment mode, the object support 14 is connected in such manner by an articulation 36 to the cross slide 28 that said support may rotate (38) about the object support 14, preferably about a horizontal axis of rotation. In an alternative the articulation 36 may also be designed to allow other displacements in other directions.

As shown in the drawings of the preferred embodiment modes of the invention, the object positioning device 12 comprises two of said compound slide units 24, one of which is denoted by 24*a* and the other by 24*b*. Preferably however both are identical. The object support 14 is connected to both transverse slides 28 by an articulation 36 whereby the said object support is displaceable relative to each transverse slide 28. In this manner the object support 14 is displaceable and positionable along the longitudinal guide 30, namely by synchronized and identical displacements of the two longitudinal slides 26; moreover the object support 14 is displaceable and positionable along the transverse guide 32 by synchronized, identical displacements of the two transverse slides 28; and the object support 14 is rotatable and positionable in the articulations 36 transversely to the longitudinal guide 30 and transversely to the transverse guide 32 by displacing at least one of the transverse slides 28 and by simultaneously displacing at least one of the longitudinal slides 26 relative to the associated other longitudinal slide 26. All said displacements are controlled and coordinated by the numerical control program of the control unit 18.

Figure 4:
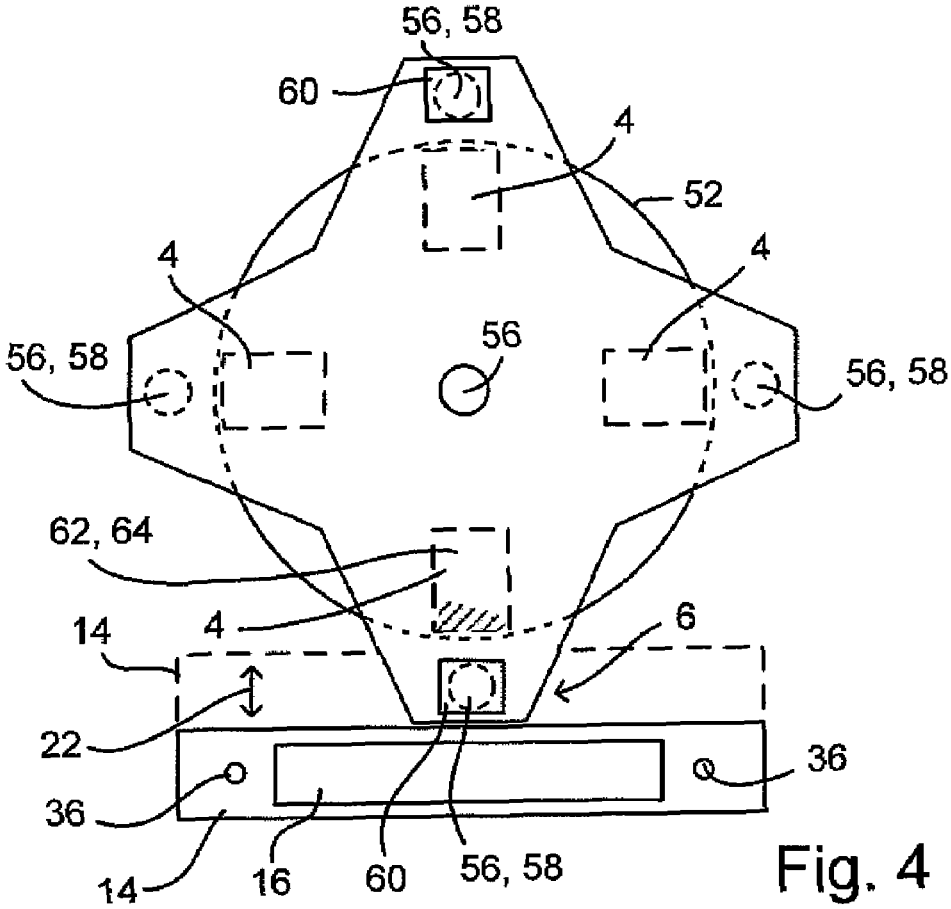
FIG. 4 is a schematic topview of the pad printing machine of FIG. 1 and of part of the object positioning device.

The pad printing machine 2 comprises a machine frame 50 and a printing unit carrier 52 configured displaceably therein, at least one and preferably several pad printing units 4 being mounted on said carrier 52. FIG. 4 shows illustratively four pad printing units 4. Illustratively six pad printing units 4 or another number may be used in other embodiments. The pad printing units 4 can be sequentially moved into the print station 6 and then out of it by means of the motions of the printing unit carrier 52, to print the object 16 in the print station. FIG. 4 shows the object support 14 in solid lines in front of, and in dashed lines within, the print station 6.

The motions of the printing unit carrier 52 may be linear.

In the preferred embodiment of the invention, the pad printing machine 2 is a turntable printing machine wherein the printing unit carrier 52 revolves about a vertical. axis of rotation 56 in order that the pad printing units 4 mounted on it be sequentially moved into the print station and then away from it to print the object in the print station 6.

Each pad printing unit 4 comprises a pad carrier 57 (FIG. 1) to hold a pad 58; a drive 60 to move the pad carrier 57 up and down jointly with the pad 58; and a cliché substrate 62 to receive a cliché 64 (also called printing plate). The cliché substrate 62 preferably is configured on a lower plate 63 and the pad carrier 57 is mounted in vertically displaceable manner in an upper plate 66. The drive 60 vertically displacing the printing pad 58 in the direction of a double arrow 68 also may be mounted on the upper rest plate 66. However in the preferred embodiment of the invention, the drive 60 is affixed in stationary manner to the printing machine frame 50 in the print station 6 and only the printing unit carrier 52 jointly with the two plates 63 and 66 shall be rotatable about the axis of rotation 56. In this manner the need for each printing unit 4 having its own drive is obviated, instead the drive 60 may be used for several printing units 4 which are sequentially moved into the print station 6 by rotating the printing unit carrier 52 about the vertical axis of rotation 56 using one drive 61. In the pad printing method of an embodiment of the invention, the cliché substrate 62 together with the cliché 64 is moved by an omitted drive between a rear and a front position. A print image zone of the cliché 64 is situated underneath an ink cup when in said rear position to receive ink at its recessed portions. When said cliché holder and cliché are in the front position, the ink filled print image zone is situated underneath the printing pad 58 which by its up-and-down motion is able to absorb ink and which thus receives the print image from the print image zone of the cliché 64. Thereupon the cliché substrate 62 jointly with the cliché is moved by said omitted drive back into its rear position. Next the printing pad 58 may be displaced by the drive 60 downward past the cliché substrate 62 onto the object to be printed to transfer the ink to the object 16. Thereupon the printing pad 58 is moved back upwards by the drive 60 and the cliché 64 may be moved again underneath the printing pad 58.

The longitudinal slides 26 are each driven by a drive 26*a* respectively 26*b*. The transverse slides 28 are each fitted with a drive 28*a* respectively 28*b*.

All drives may be linear or rotary drives, for instance being electric motors or pneumatic or hydraulic adjustment motors.

The invention claimed is:

1. A pad printing system, comprising:

a pad printing machine comprising at least one pad printing unit to apply a print to an object in at least one print station;

an object positioning device at said at least one print station, the object positioning device comprising an object support to hold the object to be printed in a plurality of different print positions in said print station, wherein the object positioning device is a multi-positioning device by means of which the object support jointly with an object to be printed are positionable automatically and sequentially in each of at least two of said different print positions in the same print station in order to print the object at said at least two corresponding print positions; and the pad printing machine is adapted to print on the object at the same print station sequentially at the at least two different print positions in particular areas of the object to be printed; and a numerical program control unit for controlling operations of the pad printing machine and of the object positioning device, said operations of the pad printing machine and of the object positioning device being matched to each other by the program control unit;

wherein the object positioning device further comprises two compound slide units each including a longitudinal slide and a transverse slide;

the longitudinal slides are displaceable relative to each other and along a longitudinal coordinate axis and are guided in longitudinal guides;

each transverse slide is displaceable along a transverse coordinate axis and is guided in a transverse guide present at a respective one of the longitudinal slides;

the transverse slides are displaceable relative to each other;

the transverse coordinate axis runs transversely to the longitudinal coordinate axis;

the object support has two opposite ends each being mounted on and connected by an articulation to a respective one of the transverse slides, said articulation allowing relative rotational motion between the respective end of the object support and the respective transverse slide;

the object support is displaceable and positionable along the longitudinal coordinate axis by means of simultaneous and identical displacement of the two longitudinal slides;

the object support is displaceable and positionable along the transverse coordinate axis by means of simultaneous and identical displacements of the two transverse slides; and the object support is rotatable and positionable transversely to both the longitudinal and transverse coordinate axes by displacement of at least one of the transverse slides relative to the other transverse slide along the transverse coordinate axis, and by simultaneous displacement of at least one of the longitudinal slides relative to the other longitudinal slide along the longitudinal coordinate axis, all said displacements being driven by the numerical program control unit.

2. The pad printing system as claimed in claim 1, wherein the longitudinal and transverse coordinate axes are perpendicular to each other.

3. The pad printing system as claimed in claim 2, wherein the longitudinal and transverse coordinate axes are configured in one plane.

4. The pad printing system as claimed in claim 1, wherein the pad printing machine further comprises a displaceable printing unit carrier bearing at least two pad printing units which by means of the printing unit carrier's motion are sequentially moveable into the print station and then away therefrom to print on the object within the print station.

5. The pad printing system as claimed in claim 1, wherein the pad printing machine is a turntable printer comprising a printing unit carrier which is rotatable about a vertical axis of rotation and which bears at least two pad printing units that, due to the rotation of the printing unit carrier, are sequentially moveable into and then out of the print station for the purpose of printing on the object within the print station.

6. A pad printing system, comprising:

a pad printing machine comprising at least one pad printing unit for printing on an object to be print in a print station;

an object positioning device at said print station, the object positioning device comprising an object support for holding the object to be printed in a plurality of different print positions in said print station; and a control unit for controlling and coordinating operations of the pad printing machine and of the object positioning device so as to sequentially print on the object at least two of the different print positions;

wherein the object positioning device further comprises two longitudinal slides displaceable along a longitudinal coordinate axis;

two transverse slides each moveably mounted on one of the longitudinal slides to be displaceable along a transverse coordinate axis;

the longitudinal slides are displaceable toward and away from each other along the longitudinal coordinate axis;

the transverse slides are displaceable relative to each other along the transverse coordinate axis by way of individual movements of the transverse slides on the respective longitudinal slides;

the transverse slides are further displaceable relative to each other along the longitudinal coordinate axis by way of relative movements of the longitudinal slides;

the transverse coordinate axis runs transversely to the longitudinal coordinate axis;

the object support has two opposite ends each being pivotably mounted on a respective one of the transverse slides, for allowing relative rotational motion between the respective end of the object support and the respective transverse slide;

the object support is displaceable and positionable along the longitudinal coordinate axis by means of simultaneous and identical displacement of the two longitudinal slides;

the object support is displaceable and positionable along the transverse coordinate axis by means of simultaneous and identical displacements of the two transverse slides; and the object support is rotatable and positionable transversely to both the longitudinal and transverse coordinate axes by displacement of at least one of the transverse slides relative to the other transverse slide along the transverse coordinate axis, and by displacement of at least one of the longitudinal slides relative to the other longitudinal slide along the longitudinal coordinate axis.

7. The pad printing system as claimed in claim 6, wherein the longitudinal and transverse coordinate axes are perpendicular to each other.

8. The pad printing system as claimed in claim 7, wherein each end of the object support is rotatable relative to the respective transverse slide in a plane parallel to the longitudinal and transverse coordinate axes.

9. The pad printing system as claimed in claim 6, wherein the pad printing machine further comprises a displaceable printing unit carrier bearing at least two pad printing units which, by means of the printing unit carrier's motion, are sequentially moveable into the print station and then away therefrom to print on the object within the print station.

10. The pad printing system as claimed in claim 6, wherein the pad printing machine is a turntable printer comprising a printing unit carrier which is rotatable about a vertical axis of rotation and which bears at least two pad printing units that, due to the rotation of the printing unit carrier, are sequentially moveable into and then out of the print station for the purpose of printing on the object within the print station.

* * * * *

UNITED STATES PATENT AND TRADEMARK OFFICE

CERTIFICATE OF CORRECTION

PATENT NO. : 7,658,146 B2
APPLICATION NO. : 11/670686
DATED : February 9, 2010
INVENTOR(S) : Holger Reinholdt It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 241 days.

Signed and Sealed this

Thirtieth Day of November, 2010

David J. Kappos

David J. Kappos
*Director of the United States Patent and Trademark Office*